United States Patent [19]

Pattermann

[11] 4,307,825

[45] Dec. 29, 1981

[54] BRICKLAYERS TROWEL HOLSTER

[76] Inventor: Norbert C. Pattermann, 320 E. Alpine St., Altamonte Springs, Fla. 32701

[21] Appl. No.: 78,458

[22] Filed: Sep. 24, 1979

[51] Int. Cl.[3] ..... B25B 29/00

[52] U.S. Cl. ..... 224/231; 150/31; 224/232; 224/253; 224/904

[58] Field of Search ..... 224/192, 193, 223, 224, 224/226, 227, 228, 231, 232–240, 243, 244, 253, 904, 911; 150/1, 1.7, 28–34, 52 R; 229/53, 55; 24/3 R, 3 E, 3 F, 3 G; 206/5, 349

[56] References Cited

U.S. PATENT DOCUMENTS

| | | | |
|---|---|---|---|
| Re. 14,650 | 5/1919 | Cooley | 229/53 |
| 1,275,862 | 8/1918 | Danz | 224/231 X |
| 1,933,171 | 10/1933 | Hart | 224/232 |
| 2,082,714 | 6/1937 | Midula | 229/55 |
| 2,092,222 | 9/1937 | Myres | 224/911 |
| 2,531,170 | 11/1950 | Tackett | 229/911 |
| 2,758,762 | 8/1956 | Medley | 224/911 |
| 3,008,617 | 11/1961 | Villwock | 224/232 X |
| 3,128,926 | 4/1964 | Stella | 229/253 X |
| 3,343,735 | 9/1967 | Breeding et al. | 224/904 |
| 3,406,884 | 10/1968 | Perkins | 224/911 |

*Primary Examiner*—Stephen Marcus
*Attorney, Agent, or Firm*—Roger L. Martin

[57] ABSTRACT

A carrier for a bricklayer's trowel is in the form of a leather holster with a pocket which is suspended from a hanger. The hanger is designed to be hung from the user's body belt. The pocket is V-shaped with an inclined edge along its upper opening so as to serve in orienting the tool in the holster. The pocket has a folded tab at the bottom to provide protection from the blade point and simultaneously provide openings through which a screwdriver can be inserted to dislodge hardened cementitious materials that inadvertently enter the pocket area. A leather blank with an integral arrangement of the leather parts other than a spacer used in the construction is shown.

1 Claim, 7 Drawing Figures

BRICKLAYERS TROWEL HOLSTER

In the process of building a brick structure, it is not uncommon for the bricklayer to set aside his trowel in order to have his hands free for some other task. Not infrequently the trowel is dislodged from its resting place and falls into an inaccessible part of the structure under construction and thereby requires replacement by the bricklayer. On other occasions, a trowel has been dislodged from a temporary resting place where scaffolding is being used and the need has risen to recover the trowel from the ground. This, of course, is a time consuming task. There is, accordingly, a need for a suitable carrier for storing the tool on the body of the bricklayer during its nonuse.

In accord with the invention, a thin, generally V-shaped pocket structure is provided for housing the blade of the bricklayer's trowel, and the pocket structure is suspended from a hanger that can be connected to the bricklayer's body belt so that the holster and trowel can be readily carried about in an accessible position during the bricklayer's work process. In accord with certain aspects of the invention, safety features are embodied in the holster structure to minimize injury to the bricklayer as the trowel is removed and inserted in the holster. Yet other features are embodied in the holster structure to protect the bricklayer from injury when the trowel is thus holstered. Yet other aspects of the invention contemplate features which facilitate the ready grasp of the tool handle by the bricklayer and its removal from the pocket by simple movement of the arm. Still other aspects of the invention provide for the removal of foreign particles and hardened cementitious materials that have found their way into the pocket structure.

The bricklayer's trowel, is, of course, a pointed instrument and to avoid injury to the bricklayer, a hanger structure is provided for the trowel receptacle and which extends above the opening to the receptacle as an integral, upward extension of the inside wall of the pocket. This hanger serves to shield the user's body from the blade as it is inserted and removed from the holster, and it also serves, through contact with the blade point, to guide the blade into the pocket during the process of holstering the trowel.

Yet another aspect of the invention has to do with the provision of a protective shield for the pointed end of the trowel blade at the bottom of the holster while nevertheless facilitating an open arrangement at the bottom of the pocket for the removal of foreign particles and particularly cementitious materials that find their way into the pocket and harden. Here, the inventor utilizes a simple leather tab which constitutes an integral extension of one of the leather wall sections of the pocket structure and which is folded upon itself at the bottom extremity of the pocket and thereabove attached to the other wall component of the pocket. This folded tab arrangement serves to shield the pointed tip of the blade from contact with the bricklayer's body. Simultaneously, the folded arrangement provides forward and rearward openings at the bottom end of the pocket and through which a screwdriver may be inserted to dislodge cementitious materials that have fallen into the bottom of the pocket and thereat hardened.

Still another aspect of the invention has to do with the maintenance of a convenient location for the handle of the housed bricklayer's trowel so as to facilitate the removal of the trowel from the holster. Field tests have shown that the bricklayers prefer to remove the holstered trowel with an arm motion that carries the hand and the grasped tool in a rearward direction at the side of the bricklayer's body and with a minimum of movement of the hand toward the shoulder. To accomplish this, it has been found that a narrow opening in a pocket that is provided with a forwardly inclined edge permits the housed trowel to come to rest with its shanks supported on the inclined edge. With this arrangement, the trowel handle tends to move to a rearwardly inclined position which facilitates its removal from the holster in the manner preferred by most bricklayers. This is especially so for housed trowels that are smaller than the maximum size which may be housed in the pocket without the blade tip in contact with a supporting bottom structure in the pocket.

Other aspects of the invention have to do with minimizing the costs of manufacture of the holster, and here the invention contemplates a leather holster in which, except for the fastening means utilized and a wall spacer component, the parts of the structure are integral and made from a single leather blank.

A general object of the invention is to provide a carrying device for a bricklayer's trowel. Still another object is to provide a carrying device for such trowels and which is safe and convenient to use by the bricklayer. One other object of the invention is to provide a holster that may be used to house bricklayer trowels of different sizes. Still a further object is to provide a holster of the type contemplated which is not only safe to use but which may be readily cleaned of cementitious materials that have hardened therein. Still other objects are to provide an inexpensive holster that is easy to manufacture.

The novel features which are believed to be characteristic of this invention are set forth with particularity in the appended claims, the invention, itself, however, both as to its organization and method of operation, together with further objects and advantages thereof, may best be understood by reference to the following description taken in connection with the accompanying drawings, wherein:

Figure 1:
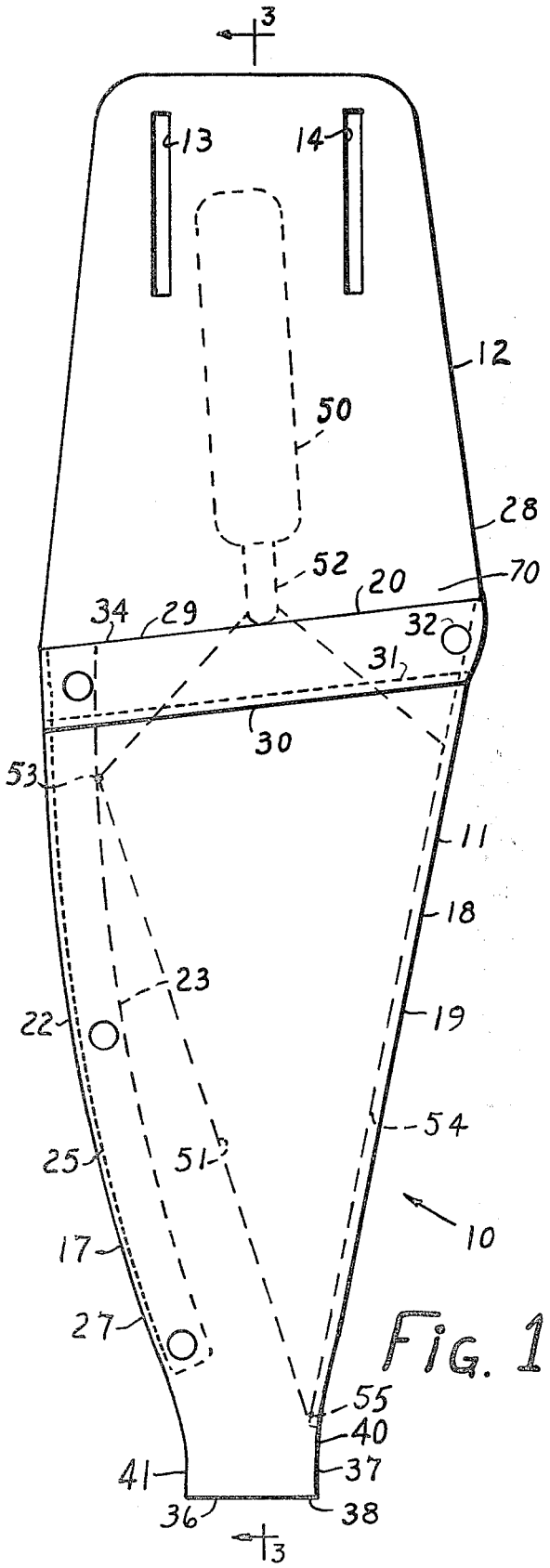
FIG. 1 is a side elevational view of an embodiment of the invention as seen at the outside of the pocket structure, certain parts in a housed bricklayer's trowel being shown in broken lines.

Reference is now made to the drawings and in particular to the holster embodying the principles of the invention which is designated at 10. The holster 10 includes a thin, generally V-shaped pocket 11 for housing the blade of a bricklayer's trowel 50. The pocket 11 is suspended from a hanger 12 which is equipped with a pair of slots 13 and 14 for receiving a body belt of the holster user.

The holster 10 is designed to hang from the user's body belt (not shown) and at one side of the user's leg. The pocket portion 11 has a generally V-shaped body side or inside wall 16 and yet another generally V-shaped wall 17 that is located at the outside of the arrangement when the holster is suspended from the user's body belt. Walls 16 and 17 confronts and serves to cover the trowel blade when it is housed in the pocket. These walls 16 and 17 are integrally joined and formed from a single leather blank 15. In the assembled holster, the front and rear side edges 19 and 22 of the pocket are downwardly converging and walls 16 and 17 are joined along a fold 18 at the front side edge 19 of the pocket arrangement.

At its upper end 20, the pocket 11 has a narrow, elongated opening 21 for receiving the trowel blade 51. The front edge fold in the leather material aids in maintaining a spaced relation between the walls 16 and 17 at the front end of opening 21 so as to facilitate insertion of the trowel blade. At the rear side edge 22 of the pocket 11, the walls 16 and 17 are separated and spaced apart by an elongated, flat, narrow leather strip 23 so as to also aid in maintaining a spaced relationship between the walls. Here the inside and outside walls 16 and 17 are joined and secured by stitches 25 and rivets 26 that attach the walls to the intervening strip 23 that is sandwiched therebetween along the adjacent rear edges 27 of the walls. The elongated side edges are horizontally spaced apart and generally downwardly converging in the thin, generally V-shaped structure of the pocket.

Figure 2:
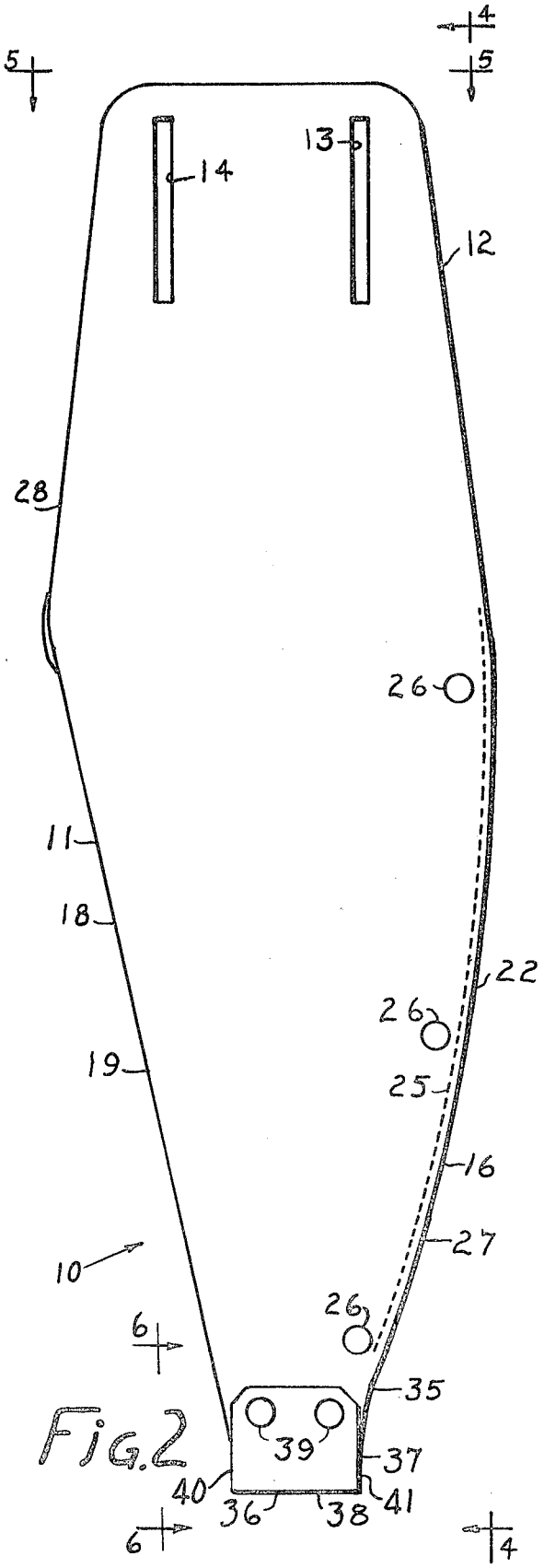
FIG. 2 is a side elevational view of the holster shown in FIG. 1 and as seen from the inside of the holster that faces the bricklayer's body.
Figure 3:
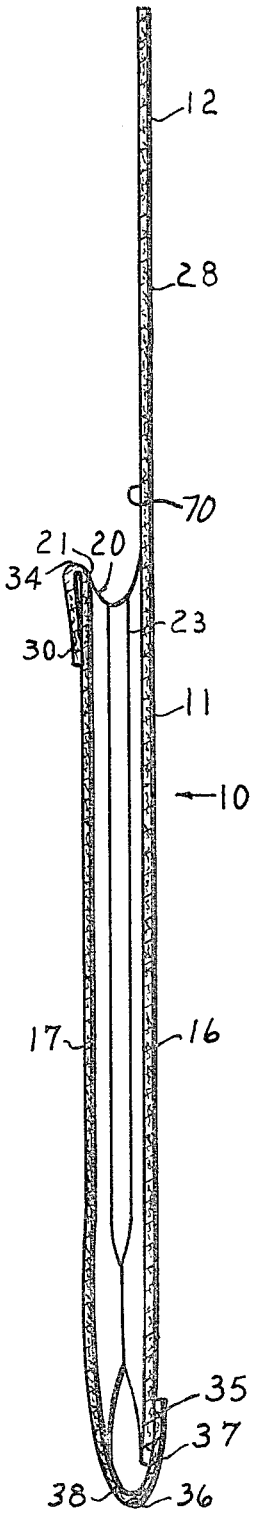
FIG. 3 is a vertical sectional view along the Lines 3—3 of FIG. 1.
Figure 4:
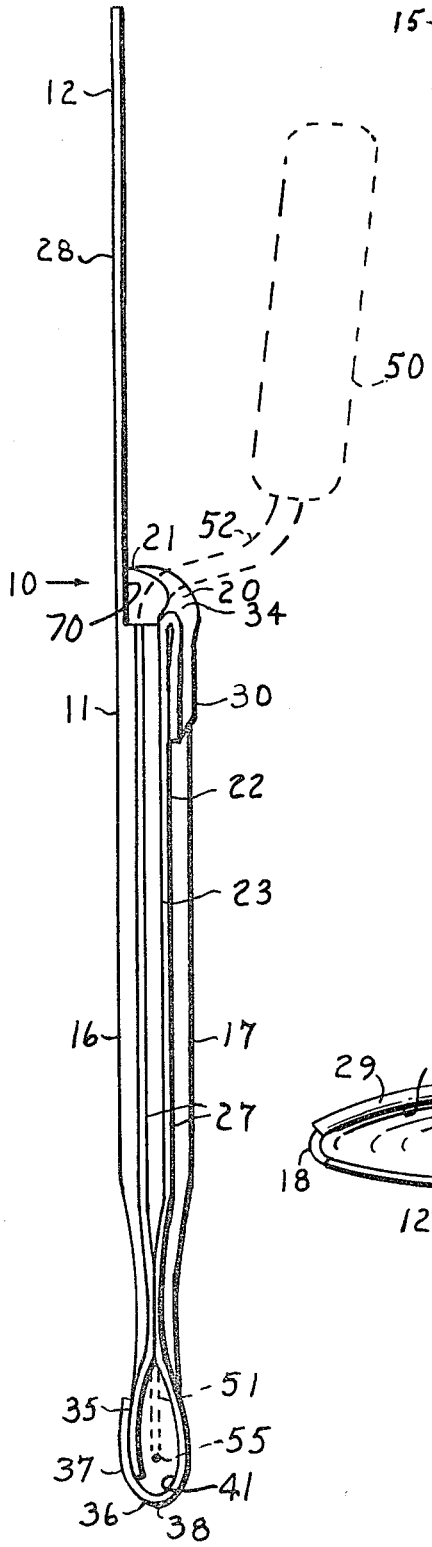
FIG. 4 is a rear elevational view along the Lines 4—4 of FIG. 2 with the trowel being shown in broken lines.
Figure 7:
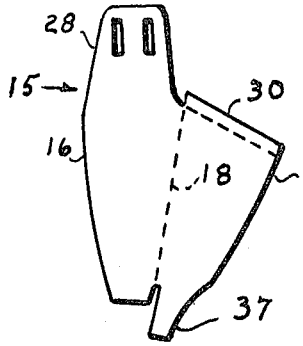
FIG. 7 is a reduced sized view of a leather blank used in the assembly of the holster.
Figure 6:
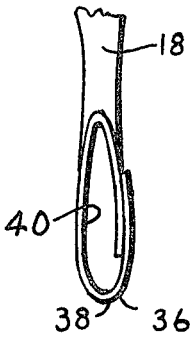
FIG. 6 is an elevational view of a fragment of the pocket structure at the front end and as seen along the Lines 6—6 of FIG. 2.
Figure 5:
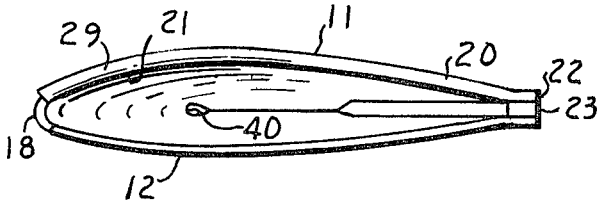
FIG. 5 is a top plan view as seen along the Lines 5—5 of FIG. 2.

The hanger is formed from a flap 28 portion of the leather blank 15 and which constitutes an integral upward extension of the inside wall 16, as is evident from FIG. 2. This flap extends above the opening 21 by a distance which is at least equal to the handle length so as to provide a substantial leather portion which serves to shield the user's body from the point 55 as the trowel is inserted in the pocket. The integral nature of the wall extension provides a continuous surface 70 at the pocket opening 21 and which is uninterrupted by fasteners and overlapping parts that would otherwise obstruct passage of the trowel blade into the opening through contact with the blade point 55. As such, the point 55 of the trowel contacts and passes smoothly over the surface 70 as the blade passes into the pocket opening 21 as the implement is holstered.

The outside wall 7 is equipped at its upper end 29 with another elongated, narrow flap 30. In this instance, the flap 30 is integrally joined with the wall portion 17. In the assembled holster, this flap 30 is outwardly folded upon the outside wall 17 and is secured to it by one of the side rivets 26 and by stitching 31 and another rivet 32 as seen in FIG. 1. The arrangement is such as to provide a forwarding inclined fold 33 that forms an upper edge 34 of the outside wall 17 and which is adapted to underlie the shank 52 attached to a trowel blade 51 housed in the pocket 11.

When the shank 52 that is attached to the blade 51 of the trowel 50 comes to rest on the folded edge 34, the shank 52 tends to slide down the edge until the side point 53 of the blade 51 (in those cases where the end point 55 of the blade does not come to rest on the bottom fold of the pocket) engages the spacer 23 and the opposite side trowel edge 54 engages the inside of fold 18. This tilts the handle 56 in a rearwardly inclined direction that facilitates the removal of the trowel 50 from the pocket by a rearward movement of the user's hand.

At the bottom end 36 of pocket 11, the outside wall 17 is equipped with a depending leather tab 37 that is integrally joined to the wall portion 17 of blank 15. This tab 37 is folded upon itself at the bottom end 36 extremity of the pocket and along a horizontal fold 38 which, as seen in the figures, is secured above the fold 38 by a pair of rivets 39 to the lower end of wall 16. This arrangement serves a twofold purpose. For one, the folded tab encompasses the end point 55 of any trowel that is long enough to project into the bottom end of the pocket area and otherwise serves as a rest for the point under circumstances where the length dimension of the blade prevents the shank from resting on edge 34. Secondly, the arrangement provides forward and rearward openings 40 and 41 respectively and through which a screwdriver or like implement may be inserted to dislodge hardened cementitious materials that have fallen to the bottom fold 38 and thereat adhered to the inside of the pocket during the carrying process.

While only a certain preferred embodiment of this invention has been shown and described by way of illustration, many modifications will occur to those skilled in the art and it is, therefore, desired that it be understood that it is intended herein to cover all such modifications that fall within the true spirit and scope of this invention.

What is claimed as new and what it is desired to secure by Letters Patent of the United States is:

1. A holster for a bricklayer's trowel having a blade, said holster comprising a hanger having means for receiving a body belt, and a thin, generally V-shaped pocket suspended from the hanger for housing the blade of the trowel therein, said pocket having an upper end, a narrow, elongated opening at said upper end for receiving the trowel blade as it is passed into the pocket, elongated front and rear side edges that are spaced apart and generally downwardly converging, and confronting inside and outside walls that are joined along said front and rear side edges for covering the trowel blade when it is housed in the pocket; said inside and outside walls being made of leather and being integrally joined along a fold at the front side edge of the pocket, said hanger comprising a leather flap that constitutes an integral upward extension of the inside wall, said outside wall having an integrally joined depending bottom leather tab which is folded upon itself along a horizontal fold at the bottom extremity of the pocket and thereabove secured to the inside wall, said outside wall also having an integrally joined upper end flap that is folded upon and secured to the outside wall along a forwardly inclined fold that extends along the narrow opening of the pocket and forms an upper edge of the outside wall, said inside and outside leather walls being spaced apart and joined along the rear side edge of the pocket, and said tab being arranged to provide forward and rearward openings at the bottom extremity of said pocket.

* * * * *